US005352874A

United States Patent [19]

Gong

[11] Patent Number: 5,352,874

[45] Date of Patent: Oct. 4, 1994

[54] APPARATUS FOR CHANGING COOKING CONTROL DATA OF AUTOMATIC COOKERS

[75] Inventor: Chun S. Gong, Kyungsangnam-Do, Rep. of Korea

[73] Assignee: Goldstar Co., Ltd., Seoul, Rep. of Korea

[21] Appl. No.: 993,834

[22] Filed: Dec. 21, 1992

[30] Foreign Application Priority Data

Dec. 21, 1991 [KR] Rep. of Korea ..... 23803/1991

[51] Int. Cl.[5] ..... H05B 6/68

[52] U.S. Cl. ..... 219/704; 219/720; 219/506; 99/325

[58] Field of Search ..... 219/10.55 B, 10.55 E, 219/506, 702, 704, 710, 719, 720; 99/325, 451, DIG. 14

[56] References Cited

U.S. PATENT DOCUMENTS

| | | | |
|---|---|---|---|
| 4,255,639 | 3/1981 | Kawabata et al. | 219/10.55 B |
| 4,295,027 | 10/1981 | Zushi et al. | 219/10.55 B |
| 4,309,584 | 1/1982 | Terakami | 219/10.55 B |
| 4,345,132 | 8/1982 | Takase et al. | 219/10.55 B |
| 4,375,586 | 3/1983 | Ueda | 219/10.55 B |
| 4,390,766 | 6/1983 | Horinouchi | 219/10.55 B |
| 4,418,262 | 11/1983 | Noda | 219/10.55 B |
| 4,568,810 | 2/1986 | Carmean | 219/10.55 B |
| 4,572,935 | 2/1986 | Karino | 219/10.55 B |
| 4,780,588 | 10/1988 | Edamura | 219/10.55 B |
| 4,816,635 | 3/1989 | Edamura | 219/10.55 B |
| 4,914,277 | 4/1990 | Guerin et al. | 219/10.55 B |
| 4,968,864 | 11/1990 | Doi et al. | 219/10.55 B |

FOREIGN PATENT DOCUMENTS 0025513 8/1980 European Pat. Off. .

*Primary Examiner*—Philip H. Leung

[57] ABSTRACT

Apparatus for changing cooking data of an automatic cooker allowing the user to change to a desired level which is capable of serving a food tasting just right to the user. The apparatus includes a power supply, a controller for controlling its peripheral equipments according to the cooking control program, a keyboard having a plurality of cooking control keys and a pair of data up/down keys, a cooking data storage unit for storing experimentally determined cooking data, a cooking state sensing circuit for sensing a cooking state, a display unit for displaying the cooking state and the selected cooking data, an output driving circuit for driving a heating device of the cooker, and a cooking data changing section for changing the cooking data. The cooking data changing section has a temporary storage unit for temporarily storing the cooking data and causing the controller to control the cooking operation according to the stored cooking data, a data control unit for incrementing or decrementing the selected cooking data, and a display control unit for causing the incremented or decremented cooking data to be displayed on the display unit.

5 Claims, 2 Drawing Sheets

APPARATUS FOR CHANGING COOKING CONTROL DATA OF AUTOMATIC COOKERS

BACKGROUND OF THE INVENTION

1. Field of the Invention

The present invention relates in general to control systems of automatic cookers such as microwave ovens. Note particularly, the present invention relates to an apparatus for changing cooking data of an automatic cooker which allows the user to optionally change cooking data before or during its automatic cooking operation as desired, thereby causing the cooker to serve a delicious food tasting just right to the user.

2. Description of the Prior Art

In a known automatic cooker such as an automatic microwave oven, automatic cooking data, such as cooking times and cooking temperatures off foods to be automatically cooked, are stored in a cooking data storage unit of a controller of the cooker. In addition, a cooking program is stored in a memory of the controller for causing the cooker to carry out a desired automatic cooking according to the stored cooking data. Hence, when the user puts raw food in a cooking chamber of the cooker and selects, using keys of a control panel or a keyboard, a desired kind of cooking and an automatic cooking mode, the controller controls the cooker to carry out the automatic cooking in accordance with cooking data corresponding to the selected kind of cooking.

Otherwise stated, the known automatic cooker is controlled to repeatedly carry out the same cooking operations for the same kind of foods in accordance with stored cooking data. Hence, the known automatic cooker serves foods of uniform tastes.

However, since the cooking time greatly influences the taste of the cooked food and users generally have different tastes for the same kind of food, it is preferred to optionally change the cooking time and the cooking temperature of the food in order to serve a food tasting just right to each individual user. Hence, it is desired to cause the cooking operation of the automatic cooker to be carried out using cooking data optionally changeable according to tastes of the users, than fixed cooking data.

From the view point of the above, the known automatic cooker has a disadvantage. That is, the known cooker performs automatic cooking operations in such a manner that the cooking operations are carried out in accordance with fixed cooking data which is already stored in its controller by the cooker manufacturer, regardless of the different tastes of the users. In this regard, the disadvantage of the known automatic cookers resides in that the user can not optionally change the cooking data, such as cooking time and cooking temperature of the food, in order to be served with a food tasting just right to him. Otherwise stated, the known automatic cooker does not allow the user to optionally change the cooking data according to his taste and, in this respect, does not serve a food tasting just right to the user but only serves foods of uniform tastes.

SUMMARY OF THE INVENTION

It is, therefore, an object of the present invention to provide an apparatus for changing cooking data of an automatic cooker in which the above disadvantage of the prior art can be overcome, and which allows the user to optionally change selected cooking data before or during the automatic cooking operation of the cooker as desired, thereby causing the cooker to serve a food tasting just right to the user, rather than a food of uniform taste.

In accordance with an embodiment, the above object of the present invention can be accomplished by providing an apparatus for changing cooking data of an automatic cooker, said cooker comprising a controller which is provided with an automatic cooking program and several kinds of cooking control data for individual cookings and controls an output driving unit by sensing, using a cooking state sensing circuit, the cooking state of a food to be cooked according to cooking control data selected in response to a key signal of a keyboard and in turn controls an automatic cooking operation of the cooker, wherein said apparatus comprises a cooking data changing section for changing cooking data selected in order to automatically carry out a desired cooking operation, thereby causing the cooker to carry out the cooking operation as changing its selected cooking data in accordance with the different tastes of the users and, as a result, serving a food tasting just right to the user rather than a food of uniform taste.

This cooking data changing section comprises a pair of data up/down keys for inputting up/down signals for changing the cooking data and a setting key for inputting changed cooking data in order to store the changed cooking data in the controller; a temporary storage unit for temporarily storing the cooking data selected by the controller and causing the controller to control the cooking operation of the cooker in accordance with the temporarily stored cooking data; a data control unit for incrementing or decrementing the selected cooking data in response to a data up or down signal of the data up/down keys; and a display control unit for causing the incremented or decremented cooking data to be displayed on a display unit of the data changing apparatus.

In accordance with this invention, upon selection of an automatic cooking mode by the user, cooking control data for the selected cooking is read and in turn temporarily stored in the temporary storage unit of the data changing section. At that time, in response to operation of one of the data up/down keys by the user, the cooking data control unit increments or decrements the selected cooking data temporarily stored in the temporary storage unit and the increment or decrement state of the data is displayed on the display unit. In this regard, the user can easily change the cooking control data to a desired level by looking at the display unit on which the changed cooking data is displayed.

When it is desired to use the changed cooking data in next cooking of the same food, the setting key is operated or pushed and, as a result, the changed cooking data which has been temporarily stored in the temporary storage unit is stored in the cooking data unit as new cooking data for the specified food.

Thereafter, in response to an input signal of the start key, the control let controls the output driving unit by sensing, using the cooking state sensing circuit, the cooking state of the food to be cooked according to the cooking control data selected and temporarily stored in the temporary storage unit, and thereafter, controls the automatic cooking operation of the cooker for the selected cooking.

In this regard, the present invention can allow the user to optionally change selected cooking data during the automatic cooking operation of the cooker as desired, thereby serving a food tasting just right to the user rather than a food of uniform taste.

BRIEF DESCRIPTION OF THE DRAWINGS

The above and other objects, features and other advantages of the present invention will be more clearly understood from the following detailed description taken in conjunction with the accompanying drawings, in which:

FIGS. 1A and 1B show an apparatus for changing cooking data of an automatic cooker of the present invention, respectively, in which:

FIG. 1A is a block diagram showing a whole construction of the apparatus: and FIG. 1B is a block diagram showing a cooking data changing section of the apparatus of FIG. 1A.

DESCRIPTION OF THE REFERRED EMBODIMENTS

Figure 1A:
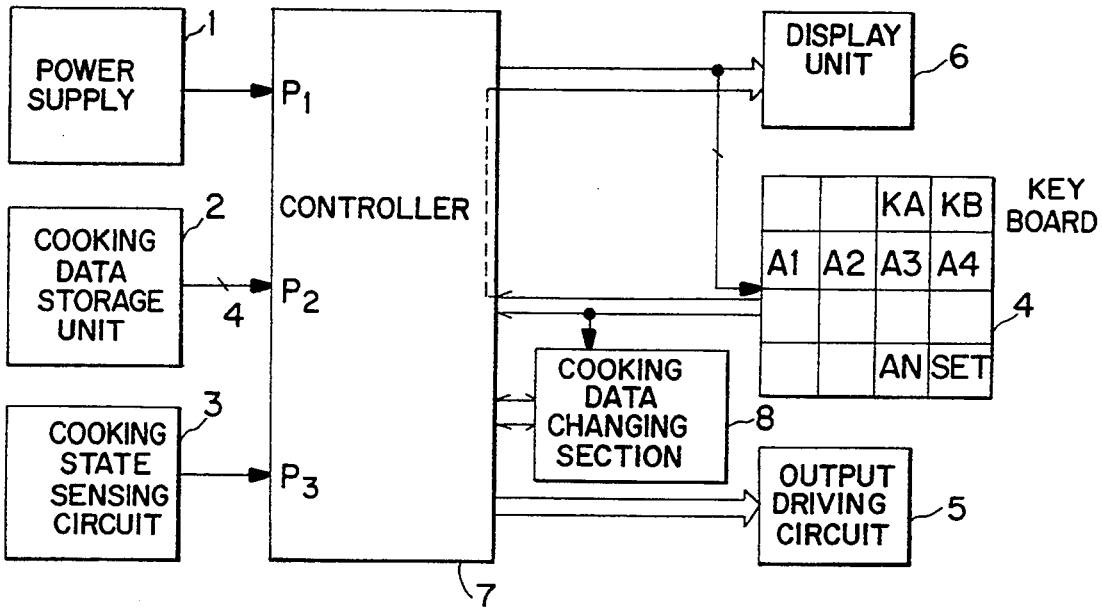

With reference to FIG. 1A which is a block diagram showing a whole construction of a cooking data changing apparatus of an automatic cooker of this invention, the apparatus includes a power supply 1 for supplying electric power for respective units of the apparatus. This power supply 1 is electrically connected to a controller 7 where an automatic cooking control program is stored in a memory and which controls peripheral equipments, which will be described below, in accordance with the stored cooking control program in order to carry out the automatic cooking operation of the cooker.

This controller 7 is connected to a keyboard 4 which is adapted to output input key signals to the controller 7. This keyboard 4 is provided with a plurality of automatic cooking control keys, a pair of data up/down keys $K_A$ and $K_B$ for changing the cooking data and a setting key SET for storing the changed cooking data in a cooking data storage unit 2 as new cooking data for a specified food. This cooking data storage unit 2 is connected to the controller 7 and adapted to store experimentally determined cooking data, for example, cooking times and cooking temperatures and etc. for several kinds of foods.

In addition, a cooking state sensing circuit 3 is connected to the input part of the controller 7 and senses the cooking state and in turn outputs a cooking state signal corresponding to the sensed cooking state to the controller 7. The controller 7 is also connected to a display unit 6 and an output driving circuit 5. The display unit 6 displays the cooking state as well as the selected cooking data under the control of the controller 7 while the output driving circuit 5 drives a heating device, for example, a magnetron, of the cooker under the control of the controller 7. The data changing apparatus of this invention further includes a cooking data changing section 8, an important part of this invention, for changing cooking data, which is selected by the controller 7, in response to a data up/down key signal of the keyboard 4.

Figure 1B:
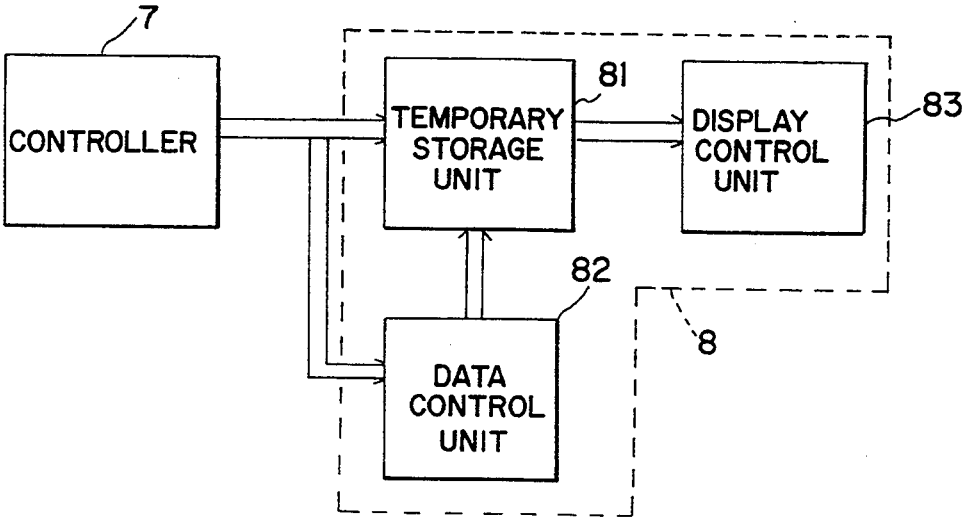

Turning to FIG. 1B showing the cooking data changing section 8 of this apparatus, the data changing section 8 comprises a temporary storage unit 81 for temporarily storing the cooking data selected by the controller 7 and causing the controller 7 to control the cooking operation of the cooker in accordance with the temporarily stored and/or changed cooking data. This temporary storage unit 81 is connected to a data control unit 82 and a display control unit 83 in order to cooperate therewith.

Here, the data control unit 82 is adapted to increment or decrement the selected cooking data in response to a data up/down key signal. The display control unit is adapted to cause the incremented or decremented cooking data to be displayed on the display unit 6 of the data changing apparatus.

Hereinbelow, the operational effect of the cooking data changing apparatus of this invention having the above construction will be described.

In the cooking data changing apparatus of this invention, the cooking data for several kinds of foods, i.e., sensor control level of the cooking state sensing circuit 3, is already stored in the cooking data storage unit 2. This cooking data is conventionally set by the manufacturer of the cooker. As described above, the present invention allows the user the option to fine tune the cooking data by controlling the data up/down keys $K_A$ and $K_B$ of the keyboard 4 and, as a result, to be served with a food tasting just right to him rather than a food of uniform taste. Hence, the cooking data changing apparatus of this invention can serve foods tasting just right to the users having different tastes.

In order to carry out a desired cooking using the cooker combined with this cooking data changing apparatus, the user selects, using the keyboard 4, a desired kind of cooking and the automatic cooking mode. As a result, keys signals corresponding to the selected cooking and the automatic cooking mode are outputted from the keyboard 4 to the controller 7. In response to the key signals of the keyboard 4, the controller 7 reads specified cooking data, corresponding to the selected cooking, of the several kinds of cooking data stored in the cooking data storage unit 2 and makes this cooking data be temporarily stored in the temporary storage unit 81 of the cooking data changing section 8.

At this time, the display unit 6 displays, under the control of the display control unit 83, the keys operated by the user as well as selected cooking data value stored in the temporary storage unit 81. Here, the selected cooking data value to be displayed on the display unit 6 is, for example, a cooking time of the selected cooking.

The user operates, thereafter, the data up/down keys $K_A$ and $K_B$ of the keyboard 4 in order to cause the cooker to carry out the automatic cooking for serving a food tasting just right to the user. In response to operation of the keys $K_A$ and $K_B$, the cooking data changing section 8 increments or decrements the cooking data temporarily stored in the temporary storage unit 81. At this time, the changed cooking data is displayed on the display unit 6 during the cooking data changing operation of the changing section 8. In this regard, the user is allowed the option to fine tune the cooking data to a desired level by looking at the display unit 6 on which the changed cooking data is displayed.

When it is required to use the changed cooking data in the next cooking of the same food, the setting key SET of the keyboard 4 is operated or pushed and, as a result, the changed cooking data which has been temporarily stored in the temporary storage unit 81 is stored in the cooking data unit 2 as the new cooking data for the specified food.

Thereafter, in response to an input signal of a start key of the keyboard 4, the controller 7 controls the output driving unit 5 as sensing, using the cooking state sensing circuit 3, the cooking state of the food to be cooked according to the changed cooking data selected and temporarily stored in the temporary storage unit 81, and therefore, controls the cooker to carry out the automatic cooking operation for the selected cooking in accordance with the changed cooking data.

In this regard, the present invention can allow the user to optionally change selected cooking data as desired, thereby serving a food tasting just right to the user rather than a food of uniform taste.

Figure 2:
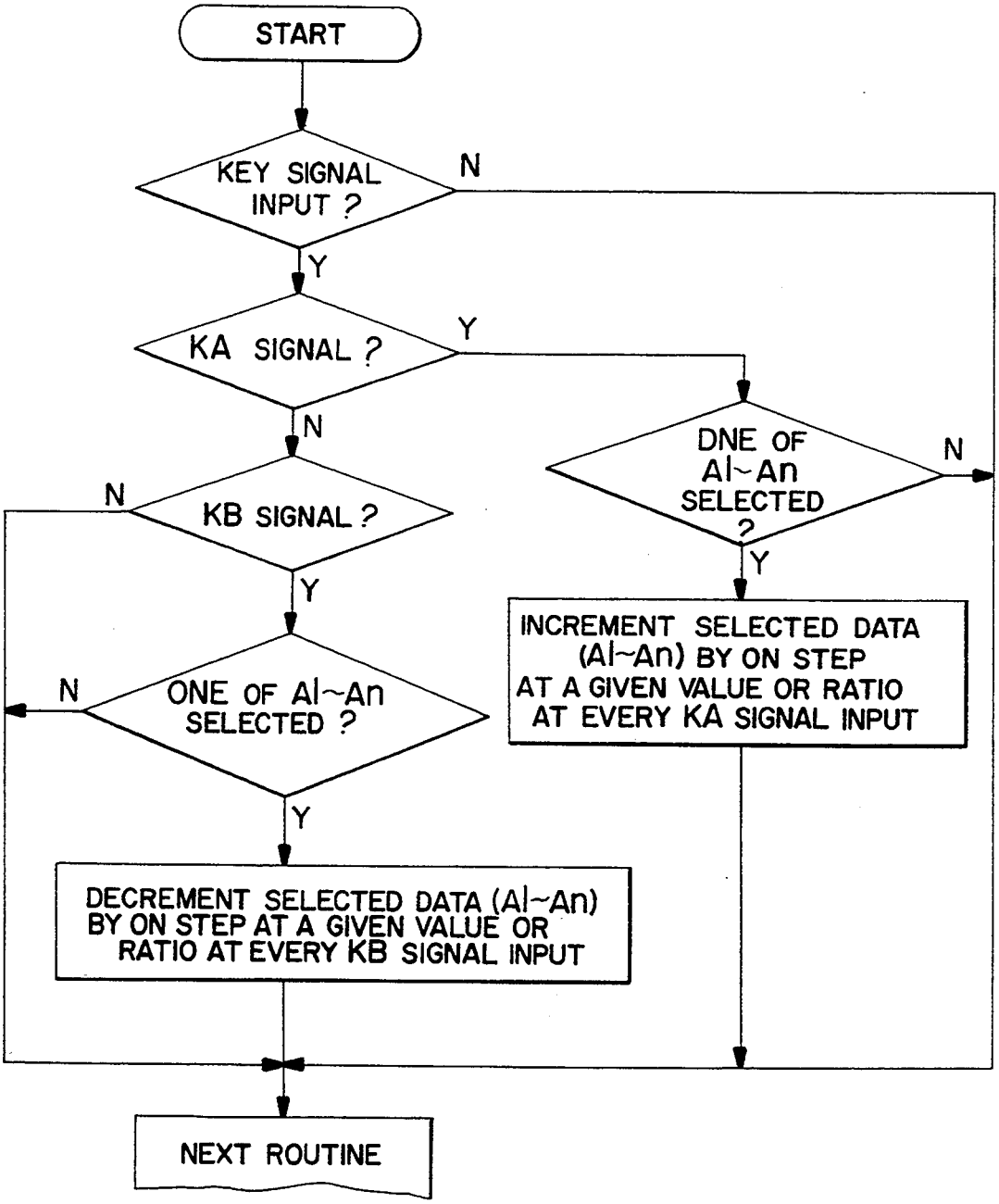
FIG. 2 is a flow diagram showing a control process for changing the cooking data performed by the apparatus of FIG. 1A.

Hereinafter, the data changing process carried out by this apparatus will be described referring to the flow diagram of FIG. 2.

When the user selects the automatic cooking mode using the keyboard 4, at a step 10 the controller 7 determines whether one of the data up/down signals of the data up/down keys $K_A$ and $K_B$ has been inputted. When the answer is yes, the controller 7 carries out a next step 11 wherein it is determined whether the data up signal of the data up key $K_A$ has been inputted. When it is determined that the data up signal has been inputted, at a step 12 the controller 7 determines whether one of the automatic cookings $A_1$ to An has been selected and stored in the temporary storage unit 81 of the data changing section 8. When one of the automatic cookings $A_1$ to An has been selected and stored in the temporary storage unit 81, a next step 13 is carried out in order to cause the data control unit 82 of the data changing section 8 to increment the selected and stored data $A_1$, $A_2$, . . . , or An by one step at a given value or ratio, for example, by 1 second for the cooking time, at every $K_A$ signal input. At this time, the changed cooking data in the temporary storage unit 81 is displayed, under the control of the display control unit 83, on the display unit 6 in such a manner that the data, for example, the cooking time is incremented by 1 second.

Meanwhile, at the step 11, when the answer is no, that is, the data up signal has not been inputted, at a step 14 it is determined whether the data down signal of the data up key $K_B$ has been inputted. When it is determined that the data up signal has been inputted, at a step 15 it is determined whether one of the automatic cookings $A_1$ to An has been selected and stored in the temporary storage unit 81 of the data changing section 8. When one of the automatic cookings $A_1$ to An has been selected and stored in the temporary storage unit 81, a next step 16 is carried out in order to cause the data control unit 82 of the data changing section 8 to decrement the selected and stored data $A_1$, $A_2$, . . . , or An by one step at a given value or ratio, for example, by 1 second for the cooking time, at every $K_B$ signal input. At this time, the changed cooking data in the temporary storage unit 81 is displayed in the same manner as described in the above data increment. However, in this data decrement, the data displayed on the display unit 6, for example, the cooking time is decremented by 1 second.

In this respect, the user is allowed to optionally fine tune the cooking data to a desired level by looking at the display unit 6 on which the changed cooking data is displayed.

Thereafter, the user operates the start key of the keyboard 4 in order to cause the cooker to carry out the desired cooking operation in accordance with the changed cooking data. In response to a start signal of the start key, the controller 7 controls the output driving unit 5 to drive the heating device such as a magnetron and, as a result, controls the automatic cooking operation of the cooker for the selected cooking in accordance with the changed cooking data stored in the temporary storage unit 81.

When it is required to use the changed cooking data in next cooking of the same food, the setting key SET is operated or pushed and, as a result, the changed cooking data which has been temporarily stored in the temporary storage unit 81 is stored, under the control of the data changing section 8, in the cooking data unit 2 as new cooking control data for the specified food. Hence, the present invention allows the user to simply reuse the changed cooking data in the next cooking of the same food.

In cooking, the controller 7 controls the cooking operation of the cooker as counting down the cooking data, for example, the cooking time, stored in the temporary storage unit 81 of the data changing section 8. In this respect, the remaining time is displayed on the display unit and this allows the user to change the cooking data by operating the data up/down keys $K_A$ and $K_B$. Hence, the present invention also allows the user to change the cooking data to a desired level during the automatic cooking of the cooker.

In the above description, the cooking data is, for example, the cooking time, however, as-well known to those skilled in the art, the cooking data may be cooking temperature and etc. besides the cooking time.

As described above, the present invention provides apparatus for changing cooking data of an automatic cooker which can allow the user to change to a desired level which is capable of serving a food tasting just right to the user. More particularly, the present invention permits the cooking data to be finely controlled or changed and, in this respect, serves a delicious food tasting just right to the user especially in cooking requiring fine heating.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. Apparatus for changing cooking data of an automatic cooker comprising:

a controller controlling said cooker in accordance with a cooking control program in order to carry out automatic cooking operation of said cooker;

a keyboard operatively connected to said controller for outputting key signals to said controller, said keyboard including a plurality of automatic cooking control keys and a pair of data up/down keys for changing cooking data;

a cooking data storage unit operatively connected to said controller for storing experimentally determined cooking data for several kinds of foods to be cooked by said cooker;

a cooking state sensing circuit operatively connected to said controller for sensing a cooking state and outputting a cooking state signal corresponding to the cooking state to said controller;

a display unit operatively connected to said controller for displaying, under the control of said controller, the cooking state as well as the selected cooking data;

an output driving circuit operatively connected to said controller for driving a heating device of said cooker under the control of said controller; and a cooking data changing section operatively connected to said controller for changing the cooking data, which is selected by said controller, in response to data up/down key signal of said keyboard, including a temporary storage unit for temporarily storing the cooking data selected by said controller and causing said controller to control the cooking operation of said cooker in accordance with the temporarily stored cooking data;

a data control unit for incrementing or decrementing the selected cooking data, being selected by said controller and stored in said temporary storage unit, in response to a data up/down key signal; and a display control unit causing the incremented or decremented cooking data of said temporary storage to be displayed on said display unit.

2. Apparatus according to claim 1, wherein said keyboard further includes a setting key for storing the changed cooking data, being changed by said cooking data changing section, in said cooking data storage unit as new cooking data for the selected cooking.

3. A cooking device controller comprising:

a permanent memory, operatively connected to said processor, for storing cooking data;

a temporary memory, operatively connected to said processor, for receiving the cooking data from said permanent memory;

an input device, operatively connected to said processor, for changing the cooking data stored in said temporary memory including, a keypad having keys for indicating the cooking data to be transferred from said permanent memory to said temporary memory, having a decrement key and an increment key for decrementing and incrementing the cooking data stored in the temporary memory, and having a store key for permanently storing the changed cooking data stored in the temporary memory in the permanent memory;

a display unit, operatively connected to said processor, for displaying the changed cooking data stored in said temporary memory; and a cooking device, operatively connected to said processor, for cooking in accordance with the changed cooking data stored in said temporary memory.

4. The cooking device controller of claim 3 further comprising:

a display control unit, operatively connected to said temporary memory, for controlling the display unit; and a data changing control unit, operatively connected to said temporary memory, for changing the data in said temporary memory in response to said input device.

5. A method of controlling a cooking device controller, said cooking device controller including a processor connected to a permanent memory, a temporary memory, an input device, a display unit and a cooking device, the method comprising:

transferring recipe data from the permanent memory to the temporary memory;

changing the recipe data stored in the temporary memory in response to the input device;

displaying the changed recipe data stored in the temporary memory on the display unit;

cooking in accordance with the changed recipe data stored in the temporary memory; and storing the changed recipe data stored in the temporary memory in the permanent memory in response to the input device.

* * * * *